US006544054B2

(12) United States Patent
Ishikawa et al.

(10) Patent No.: US 6,544,054 B2
(45) Date of Patent: Apr. 8, 2003

(54) LEVER-TYPE CONNECTOR

(75) Inventors: Ryotaro Ishikawa, Yokkaichi (JP); Yuuichi Nankou, Yokkaichi (JP)

(73) Assignee: Sumitomo Wiring Systems, Ltd., Mie (JP)

( * ) Notice: Subject to any disclaimer, the term of this patent is extended or adjusted under 35 U.S.C. 154(b) by 0 days.

(21) Appl. No.: 09/993,657

(22) Filed: Nov. 27, 2001

(65) Prior Publication Data

US 2002/0064984 A1 May 30, 2002

(30) Foreign Application Priority Data

Nov. 28, 2000 (JP) ..... 2000-361238

(51) Int. Cl.[7] ..... H01R 13/62
(52) U.S. Cl. ..... 439/157; 439/160; 439/372
(58) Field of Search ..... 439/157, 160, 439/372

(56) References Cited

U.S. PATENT DOCUMENTS 5,252,084 A * 10/1993 Wakata ..... 439/157
5,562,465 A 10/1996 Taguchi et al. ..... 439/157
5,681,175 A * 10/1997 Busse et al. ..... 439/157
5,810,612 A * 9/1998 Flask et al. ..... 439/157
5,938,458 A * 8/1999 Krehbiel et al. ..... 439/157
6,019,618 A * 2/2000 Nakata ..... 439/157
6,213,795 B1 * 4/2001 Drescher et al. ..... 439/157

FOREIGN PATENT DOCUMENTS

EP 843 386 A1 5/1988 ..... H01R/13/629
EP 606 967 A2 7/1994 ..... H01R/13/629
EP 1 028 494 A2 8/2000 ..... H01R/13/629
JP 3-126379 12/1991 ..... H01R/13/629

* cited by examiner

*Primary Examiner*—Lynn D. Feild
*Assistant Examiner*—Hae Moon Hyeon
(74) *Attorney, Agent, or Firm*—Banner & Witcoff, Ltd.

(57) ABSTRACT

The invention provides means for preventing arms of a lever from moving outwards and changing shape, without having to increase the size of a connector. Thin members 55 of arms 52 make contact with thick members 62 of protecting walls 60, thereby preventing the arms 52 from moving outwards. Since the portions of the protecting walls 60 that make contact with the arms 52 are thick, they do not change shape due to their receiving a pushing force from the arms 52. The arms 52 are thus reliably prevented from changing shape. Further, the thick members 62 are located so as to correspond to the thin members 55 of the arms 52. Consequently, the portions where the thick members 62 and the thin members 55 overlap do not become overly thick, and the connector does not increase in size.

5 Claims, 14 Drawing Sheets

LEVER-TYPE CONNECTOR

TECHNICAL FIELD

The present invention relates to a lever-type connector.

BACKGROUND TO THE INVENTION

A conventional lever-type connector is described in JP 3-126379. This lever-type connector has a male and a female connector, the female connector having a rotatable lever provided thereon. The lever has a pair of plate-shaped arms that extend along outer faces of the female connector. The lever is rotated when cam grooves of the arms and cam pins of the male connector are in an engaged state, the cam operation drawing the two connectors mutually closer and fitting them together.

In conventional lever-type connectors, the fitting resistance between the two connectors is focused at the mutually fitting portions of the cam grooves and the cam pins. As a result, the arms may separate from the outer faces of the female connector. That is, these arms may change shape so as to move outwards. In the conventional lever-type connector described above, protecting walls are formed on the outer faces of the female connector, and the arms are housed between these protecting walls and the outer faces of the female connector. Consequently, outer faces of the arms strike against inner faces of the protecting walls, thus preventing the arms from moving outwards.

As the number of terminal fittings in a connector is increased, fitting resistance also increases, and the force causing the arms to change shape and move outwards also increases. As a result, in order to prevent these arms from moving outwards, the protecting walls must be made more rigid. This may be done by thickening the protecting walls. However, if the protecting walls are made thicker, the female connector will become correspondingly larger.

The present invention has taken the above problem into consideration, and aims to prevent a lever-type connector wherein, without increasing the size of the connector, the arms of the lever are reliably prevented from changing shape and moving outwards.

SUMMARY OF THE INVENTION

According to the invention there is provided a lever-type connector comprising a housing having a lever pivoted thereon, said lever defining a cam groove for engagement with a cam follower of a mating connector whereby rotation of said lever relative to said housing causes said connectors to be drawn into engagement, wherein the housing includes a protective wall extending partly over said lever to prevent bending thereof in a direction perpendicular to the plane of movement thereof, characterized in that a thinned portion of said lever corresponds with a thickened portion of said protective wall.

Such an arrangement ensures that the overall size of the connector is not increased. In the case of a plate-like lever, the thinned portion is located furthest from the pivot axis, and the thickened portion is located adjacent a connecting web of the protective wall. Such an arrangement minimizes the stabilizing force by applying it at a distance from the pivot axis.

Preferably the thinned and thickened portions are in close mutual engagement.

In a preferred embodiment the thinned portion is about half the thickness of a plate-like lever, and has a radial extent of less than 20% of the corresponding radius of the lever.

BRIEF DESCRIPTION OF DRAWINGS

Other features of the invention will be apparent from the following description of a preferred embodiment shown by way of example only in the accompanying drawings, in which.

DESCRIPTION OF PREFERRED EMBODIMENT

Figure 1:
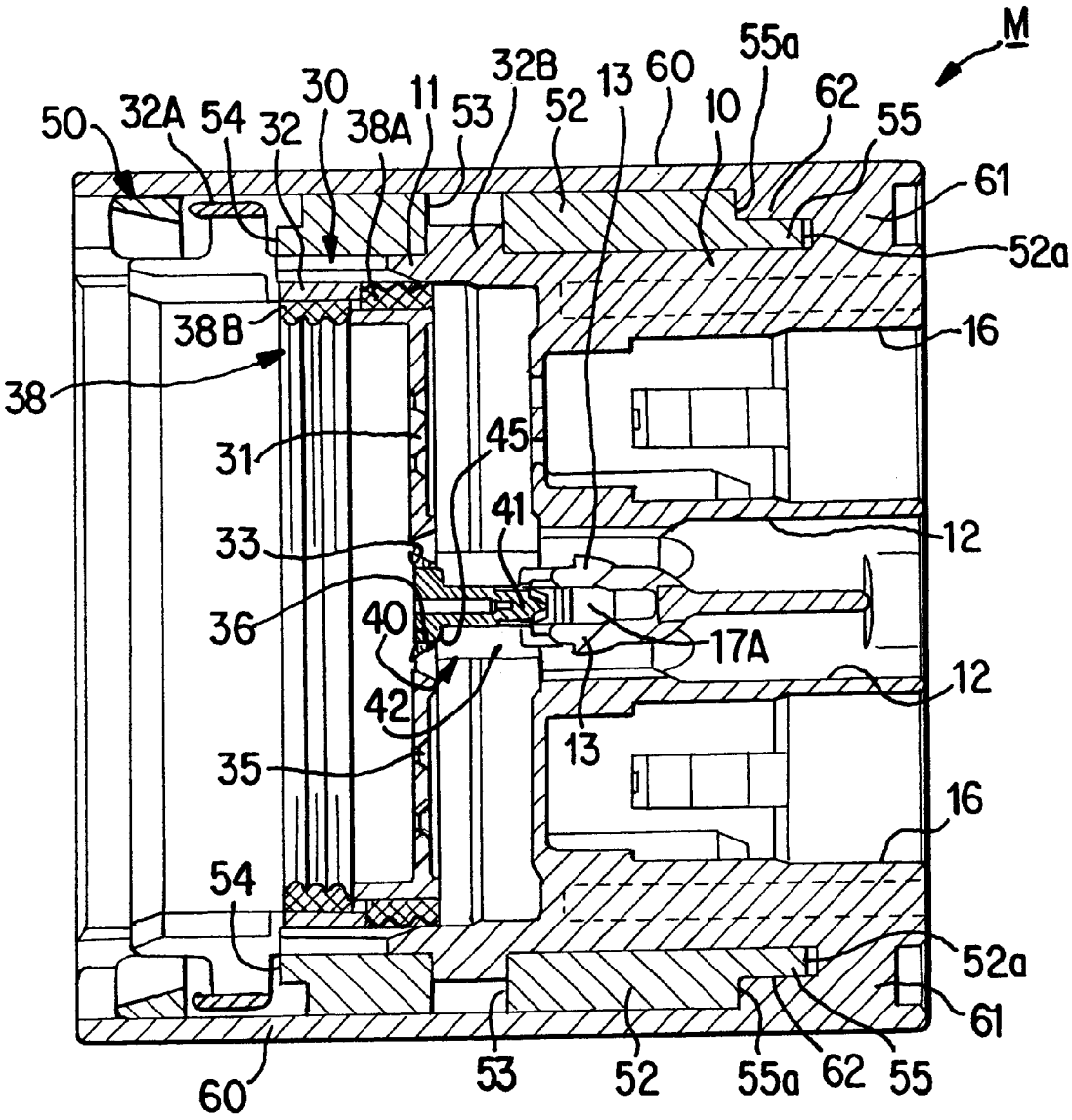
FIG. 1 is a cross-sectional view along line 1—1 in FIG. 5 showing a retainer in a temporary retaining state.

An embodiment of the present invention is described below with the aid of FIGS. 1 to 17.

A male connector M of the present embodiment is provided with a connector housing 10, male terminal fittings 20, a moving plate 30, a retainer 40, and a lever 50. In the following description, the anterior direction is on the left side with reference to FIG. 1, and the up-down direction is also taken with reference to FIG. 1.

The connector housing 10 is formed from plastic. A hood 11 protrudes to the anterior from an outer circumference of an anterior end face of this connector housing 10. A plurality of cavities 12 are formed within the connector housing 10, these cavities 12 being located therein in an approximately central location relative to the up-down direction thereof, and being horizontally aligned in an upper and a lower row. The male terminal fittings 20, which are inserted into these cavities 12, are doubly retained therein by plastic lances 13 and the retainer 40. Large diameter cavities 14 are formed to the left and right of the two rows of cavities 12. Terminal fittings (not shown) inserted into these large diameter cavities 14 are retained only by plastic lances 15. Housing grooves 16, into which sub connectors (not shown) are fitted from the posterior, are formed above and below the cavities 12.

The upper and lower rows of cavities 12 are symmetrical. The plastic lances 13 are formed in the anterior end portions thereof and extend towards the anterior in a cantilevered shape. The plastic lances 13 of the upper rows extend along lower faces of the cavities 12, and the plastic lances 13 of the lower rows extend along upper faces of the cavities 12. Bending spaces 17A, which allow the plastic lances 13 to bend resiliently, are formed between the upper and lower rows of plastic lances 13 and open onto an anterior end face of the connector housing 10. The plastic lances 13 bend resiliently into the bending spaces 17A as a result of making contact with the male terminal fittings 20 while these are being inserted from the posterior into the cavities 12. This contact is released after the male terminal fittings 20 have been inserted to a correct position, the plastic lances 13 return resiliently to their original position and engage with the male terminal fittings 20, thereby retaining them. After the male terminal fittings 20 have been inserted, tabs 21 at anterior ends thereof protrude from the anterior end face (an innermost face of the hood 11) of the connector housing 10 into the hood 11.

The bending spaces 17A join with one another between the adjacent cavities 12, thereby forming, in their entirety, a long and narrow slit that extends in a left-right direction. When the bending spaces 17A are in a free state, whereby the plastic lances 13 have not bent resiliently therein, a removal preventing member 41 of the retainer 40 can be fitted into the bending spaces 17A from the anterior in a manner whereby this removal preventing member 41 does not rattle up or down. Furthermore, a left and right pair of guiding holes 17B is formed at the left and right sides, respectively, of the bending spaces 17A. These guiding holes 17B join with the bending spaces 17A and open into the anterior end face of the connector housing 10. Guiding members 42 of the retainer 40 can be fitted into these guiding holes 17B in a manner whereby they do not rattle in the up-down or left-right directions. The bending spaces 17A and the pair of guiding holes 17B form a retainer attachment hole 17 that opens into the innermost face of the hood 11 of the connector housing 10. Moreover, temporary retaining receiving members 18A and main retaining receiving members 18B protrude from inner side faces of the guiding holes 17B. Stopping members 43 of the retainer 40 engage with these receiving members 18A and 18B, thereby maintaining the retainer 40 in a temporary retaining position and a main retaining position, respectively, relative to the connector housing 10.

Next, the moving plate 30 will be described. The moving plate 30 is made from plastic, and fixes the position of the tabs 21 of the male terminal fittings 20 (these tabs 21 protrude from the anterior end face (the innermost face of the hood 11) of the connector housing 10 into the hood 11). The moving plate 30 is formed in a unified manner from a sheet-shaped plate main body 31, which is parallel to and has the same shape as the anterior end face of the connector housing 10, and a guiding cylindrical member 32 that protrudes towards the anterior from the outer circumference of the plate main body 31 and makes contact with the inner circumference of the hood 11. The plate main body 31 is provided with position fixing holes 33, 34 and 35. The tabs 21 of the male terminal fittings 20 that have been inserted into the upper and lower rows of cavities 12 pass through the position fixing holes 33. Tabs protruding from male terminal fittings (not shown) of the sub connectors fitted into the housing grooves 16 pass through the position fixing holes 34. Tabs of the male terminal fittings (not shown) inserted into the large diameter cavities 14 pass through the position fixing holes 35.

A window hole 36, which connects with the bending spaces 17A and the guiding holes 17B of the connector housing 10, and which is formed on the face opposite the retainer 40 (the retainer attachment hole 17), passes through the plate main body 31 from the anterior face to the posterior face thereof. The shape and dimensions of the window hole 36 are such that the retainer 40 can be passed therethrough. The window hole 36 is located between the rows of position fixing holes 33 (the tabs 21 of the male terminal fittings 20 inserted into the upper and lower rows of cavities 12 are passed through these position fixing holes 33). Recesses 37 are formed at upper and lower edges of the window hole 36, each recess 37 joining individually with one of the position fixing holes 33. Supporting members 45 of the retainer 40 pass through these recesses 37. As will be described later, the window hole 36 is covered by the retainer 40.

A sealing member 38 is formed in a unified manner on the guiding cylindrical member 32 of the moving plate 30. This sealing member 38 is formed from an outer circumference sealing member 38A, which extends along an outer circumference of a posterior end portion of the guiding cylindrical member 32 (i.e., the portion thereof close to the plate main body 31), and an inner circumference sealing member 38B, this being located further towards the anterior than the outer circumference sealing member 38A and extending along an inner circumference of the guiding cylindrical member 32. These sealing members 38A and 38B are connected via a plurality of joining holes 39 formed at intervals along the circumference thereof. Further, a cam pin receiving member 32A is formed in each of the upper and lower sides the guiding cylindrical member 32.

The lever 50 is attached to the connector housing 10. This lever has an operating member 51, and a pair of plate-shaped arms 52 protrude from upper and lower ends of this operating member 51. The arms 52 extend along upper and lower faces of the connector housing 10. When rotative axes 32B are in a fitted state within axis receiving holes 53 of the arms 52, the lever 50 is supported in a state whereby it can be rotated with these rotative axes 32B serving as the centre. Cam grooves 54 are formed in the arms 52. The cam pin receiving members 32A of the moving plate 30 and cam pins Fa of a female connector F (the corresponding connector of the present invention) fit, in a unified state, into these cam grooves 54.

When the lever 50 is in a starting position (see FIGS. 1 to 3), the cam pin receiving members 32A are fitted into openings of the cam grooves 54. Posterior ends of the cam pin receiving members 32A make contact with inner faces of the cam grooves 54, this preventing the moving plate 30 from moving towards the posterior and maintaining it in a waiting position. In this waiting position, the position fixing holes 33 are fitted with the ends of the tabs 21 that protrude into the hood 11. Further, while the male connector M and the female connector F are fitted together, the cam pins Fa of the female connector F and the cam pin receiving members 32A are fitted together to form a unified state. Then, while in this state, the lever 50 is rotated to a fitting position. Then the cam pins Fa and the cam pin receiving members 32A, in their unified state, engage with the cam grooves 54, this drawing the female connector F in a posterior direction (towards the innermost face of the hood 11). That is, the cam operation of the lever 50 draws the female connector F and the moving plate 30 (these two being in a unified state) towards the connector housing 10 until a fitted state is reached. When the two connectors M and F have been fitted together, the moving plate 30 reaches the fitting position (see FIG. 4), and the position fixing holes 33 are fitted with base end portions of the tabs 21. In this manner, the moving plate 30 is moved between the waiting position and the fitting position.

The retainer 40 is made from plastic, and is moulded in a unified manner so that it has the removal preventing member 41 that extends as a long horizontal plate in a left-right direction, and the pair of guiding members 42 that are formed on the left and right ends of the removal preventing member 41, these guiding members 42 having long plate-shaped faces which extend in an anterior-posterior direction and are formed at approximate right angles to the removal preventing member 41. Both the removal preventing member 41 and the guiding members 42 form an approximately unified face at the anterior end face of the retainer 40. However, posterior end portions of the guiding members 42 protrude further towards the posterior (the direction in which the retainer 40 is attached to the connector housing 10) than the removal preventing member 41.

The stopping members 43 are formed as an anterior and posterior protruding pair in each of outer side faces of the posterior end portions of the guiding members 42 (i.e., those portions protruding to the posterior relative to the removal preventing member 41). The stopping members 43 fit with the temporary retaining receiving members 18A of the guiding holes 17B in a manner whereby they grip the temporary retaining receiving members 18A from the anterior and posterior sides thereof, thereby maintaining the retainer 40 in the temporary retaining position relative to the connector housing 10. When the retainer 40 is in the temporary retaining position, the removal preventing member 41 is not in an inserted state within the bending spaces 17A. Consequently, the plastic lances 13 are able to bend resiliently into these bending spaces 17A, allowing the male terminal fittings 20 to be inserted into or removed from the cavities 12.

When the retainer 40 is pushed inwards from the temporary retaining position to the main retaining position, the stopping members 43 fit with the main retaining receiving members 18B of the guiding holes 17B in a manner whereby they grip the anterior and posterior sides thereof, this maintaining the retainer 40 in the main retaining position relative to the connector housing 10. When the retainer 40 is in the main retaining position, the removal preventing member 41 is fitted into the bending spaces 17A in such a manner that it does not rattle. Consequently, the plastic lances 13 are prevented from bending resiliently towards the bending spaces 17A (i.e., in the direction for removing the male terminal fittings 20), thereby preventing the male terminal fittings 20 from being removed.

Figure 2:
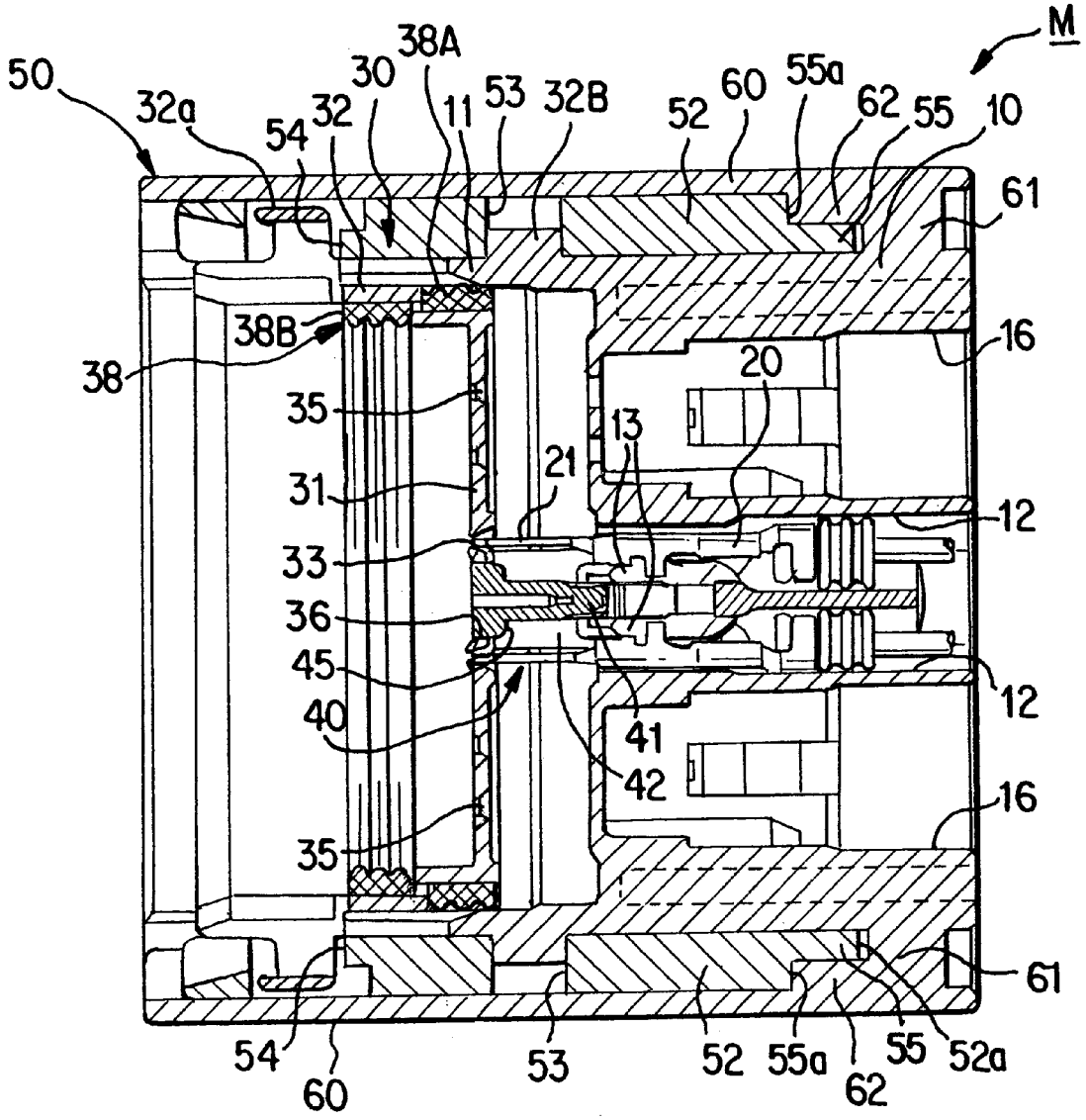
FIG. 2 is a cross-sectional view along the same line as FIG. 1 showing terminal fittings in an inserted state whereby they are temporarily retained by the retainer.
Figure 3:
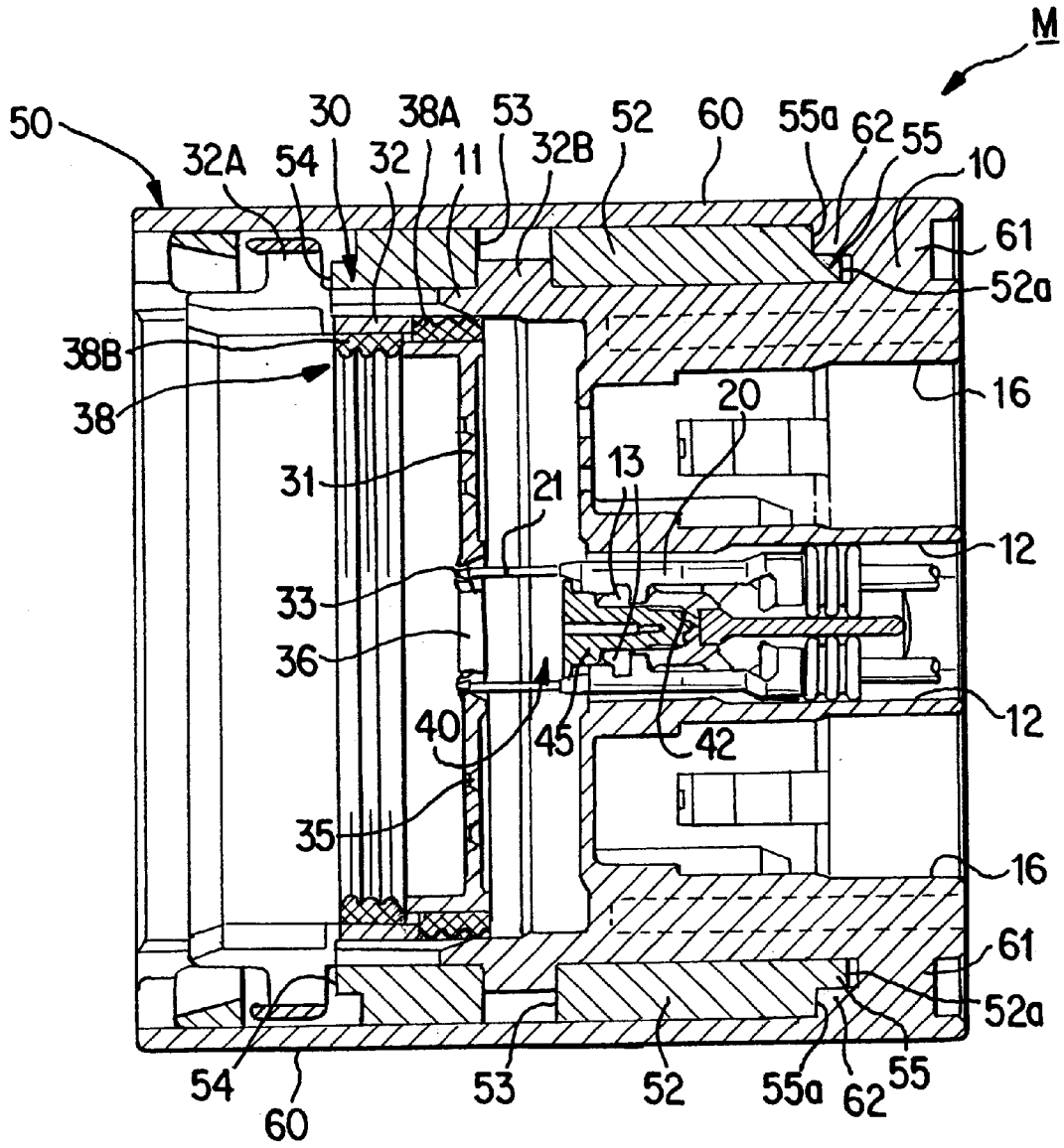
FIG. 3 is a cross-sectional view along the same line as FIG. 1 showing the retainer in a main retaining state.

As shown in FIGS. 1 and 2, when the moving plate 30 is in the waiting position and the retainer 40 is in the temporary retaining position, the anterior end face of the retainer 40 and the anterior face of the plate main body 31 of the moving plate 30 form an approximately unified face, an anterior end face portion of the retainer 40 covering the window hole 36 of the moving plate 30.

Further, the posterior end portions of the guiding members 42 (i.e., the tips thereof relative to the direction in which the retainer 40 is attached to the retainer attachment hole 17) grow gradually smaller in the up-down direction, forming tapered guiding tips 44. The anterior end portion of the removal preventing member 41 has the supporting members 45 formed thereon at locations corresponding to the cavities 12 (i.e., corresponding to each plastic lance 13), these supporting members 45 protruding upwards and downwards, respectively. When the retainer 40 is in the main retaining position, these supporting members 45 make contact, via the bending spaces 17A, with the anterior end portions of the male terminal fittings 20. Consequently, the anterior end portions of the male terminal fittings 20 are prevented from inclining towards the bending spaces 17A, thereby maintaining the male terminal fittings 20 in a stable position. Moreover, when the retainer 40 is in the main retaining position, the supporting members 45 make contact with anterior ends of the plastic lances 13, thereby functioning as stoppers which prevent the retainer 40 from being pushed in too far.

Next, the means will be described that prevents the arms 52 of the lever 50 from changing shape and moving outwards. The fitting resistance of the two connectors M and F is focused at the mutually fitting portions of the cam grooves 54 and the cam pins Fa. As a result, the arms 52 may move in a direction of separation from the outer faces of the connector housing 10, i.e., they may change shape so as to move outwards (upwards or downwards). The present embodiment presents a means to prevent this. That is, thin members 55 are formed in a concave manner in portions of outer faces of the arms 52. These thin members 55 extend along the outer circumference edges of the arms 52. Inner circumference ends 55*a* of the thin members 55 are arc shaped and are approximately concentric with the rotative axes 32B.

Protecting walls 60 are formed on the upper and lower faces of the connector housing 10. These protecting walls 60 are supported thereon by arc-shaped supporting members 61 that extend as webs along the path of rotation of arc members 52*a* formed on the outer circumference edge of the arms 52 at locations farthest from the rotative axes 32B. The protecting walls 60 are provided so as to correspond to the outer faces of the arms 52 (i.e., the faces thereof facing away from the connector housing 10). As a result, each arm 52 is housed within a narrow slit-shaped space formed between the connector housing 10 and one of the protecting walls 60. A thick member 62 is formed on each protecting wall 60 as a means to prevent each arm 52 from moving outwards. These thick members 62 protrude from inner faces of the protecting walls 60 along locations corresponding to the thin members 55 of the arms 52. The thick members 62 extend along the supporting members 61 (these supporting the protecting walls 60 on the connector housing 10) of the protecting walls 60.

The thin members 55 of the arms 52 and the thick members 62 of the protecting walls 60 are formed such that at least a portion of the thin members 55 overlaps with the thick members 62 when the lever 50 is rotated. Further, the thick members 62 do not overlap with any portion of the arms 52 other than the thin members 55, no matter the position of the lever 50 along its rotative path. That is, portions of the thin members 55 and the thick members 62 mutually overlap.

Next, the operation of the present embodiment will be described. When the connector of the present embodiment is to be assembled, the moving plate 30 is first housed within the hood 11 (see FIG. 1). The moving plate 30 is maintained in a fitting waiting position located to the anterior of the anterior end face (the innermost face of the hood 11) of the connector housing 10, a space remaining between the two. Next, the retainer 40 is attached, in the temporary retaining state, to the connector housing 10 by being passed through the window hole 36 of the moving plate 30. At this juncture, posterior end portions of the guiding members 42 of the retainer 40 are fitted into the guiding holes 17B of the retainer attachment hole 17, and the stopping members 43 of the retainer 40 engage with the temporary retaining receiving members 18A. By this means, the retainer 40 is maintained in the temporary retaining position (see FIG. 1). The retainer 40 is located such that the anterior end face thereof forms an approximately unified face with the anterior end face of the plate main body 31 of the moving plate 30, the window hole 36 of the moving plate 30 being covered by the retainer 40.

From this state, the male terminal fittings 20 are inserted into the cavities 12 and are retained by the plastic lances 13. Moreover, the tips of the tabs 21 protruding from the anterior end face of the connector housing 10 are fitted into the position fixing holes 33 of the moving plate 30 (see FIG. 2). By this means, the tabs 21 are maintained in a state whereby they do not move in the up-down or left-right directions, and are ready to be fitted with female terminal fittings (not shown) of the female connector F.

After all the male terminal fittings 20 have been fitted, the retainer 40 is pushed in from the temporary retaining position to the main retaining position. This may be done by pushing, with a finger, the anterior end face of the retainer 40 that is visible to the eye and protrudes from the window hole 36 of the moving plate 30 so as to form an approximately unified face therewith. After the retainer 40 has been pushed to the main retaining position, the removal preventing member 41 fits within the bending spaces 17A, thereby preventing the plastic lances 13 from bending resiliently in the direction that allows the male terminal fittings 20 to be removed. By this means, the male terminal fittings 20 are maintained in a doubly retained state within the cavities 12, being retained by the plastic lances 13 and doubly retained by the retainer 40.

After the male connector M has been assembled in the manner described above, the lever 50 may be rotated to fit the female connector F into the hood 11. The female connector F and the moving plate 30 are moved as a single unit while the female connector F is being fitted, and the tabs 21 that are maintained in position by the position fixing holes 33 of the moving plate 30 are reliably fitted together with and make contact with the female terminal fittings of the female connector F.

Figure 4:
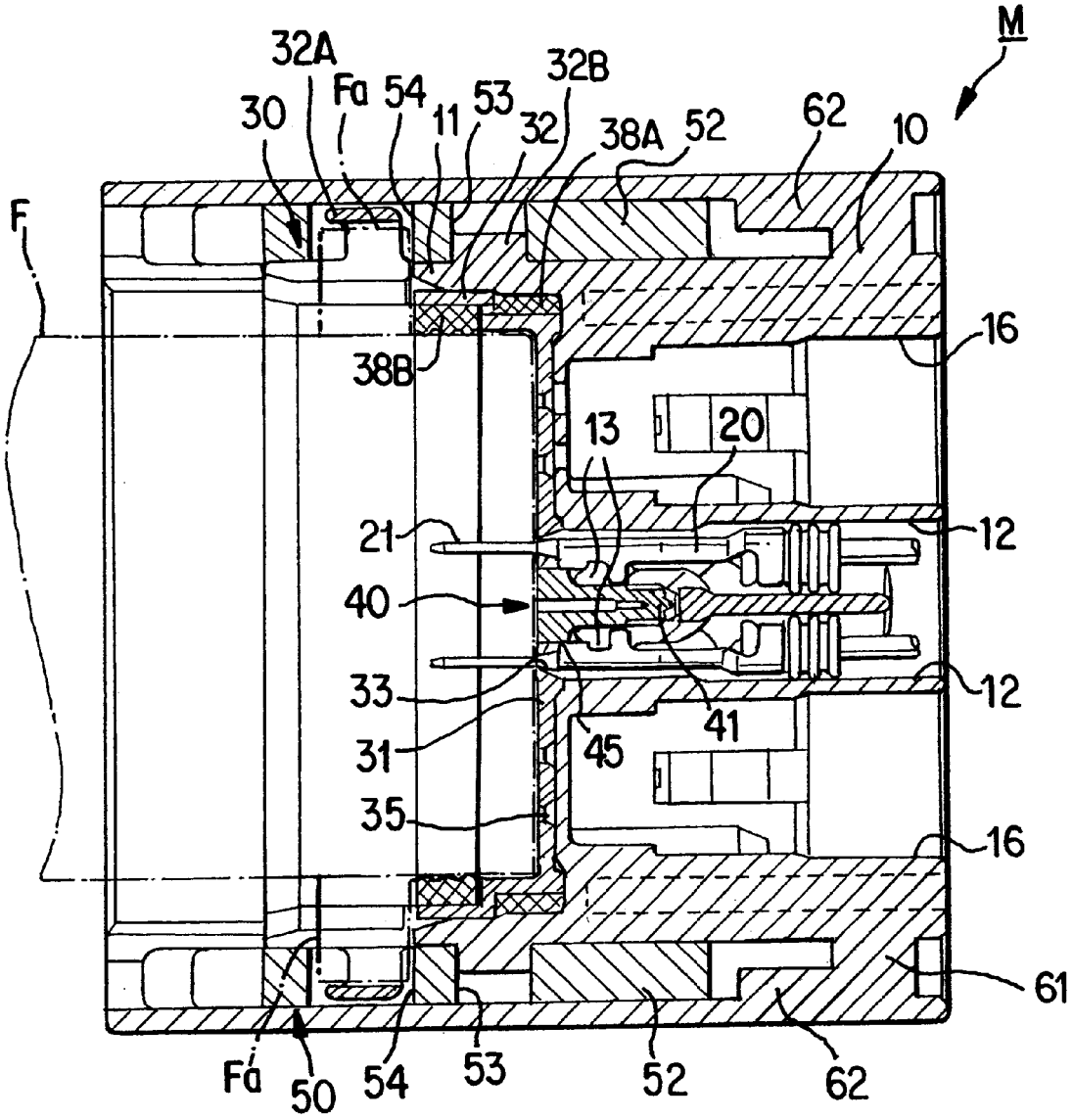
FIG. 4 is a cross-sectional view along the same line as FIG. 1 showing a connector fitted with a corresponding connector.
Figure 5:
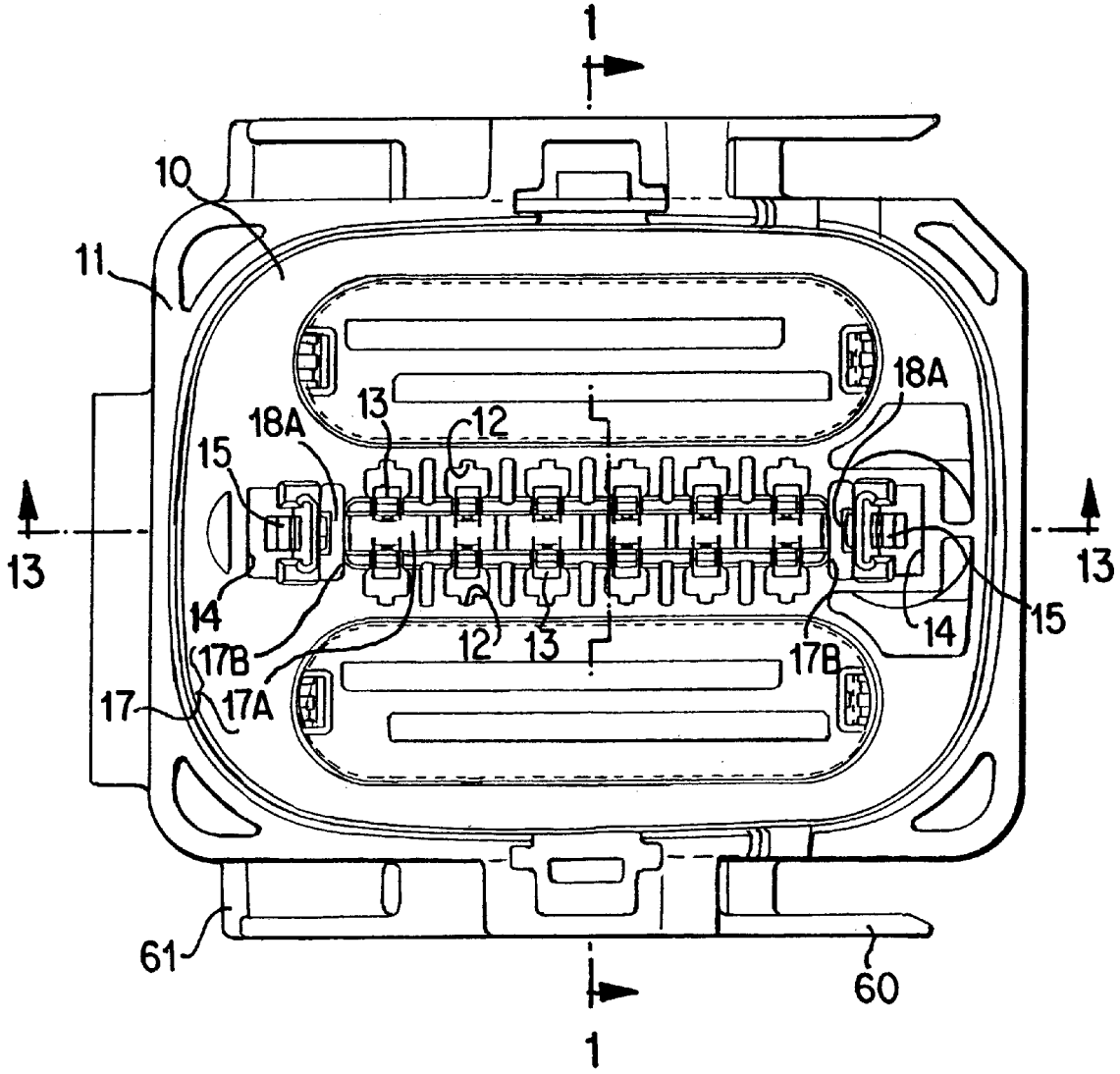
FIG. 5 is a front view of a connector housing.
Figure 6:
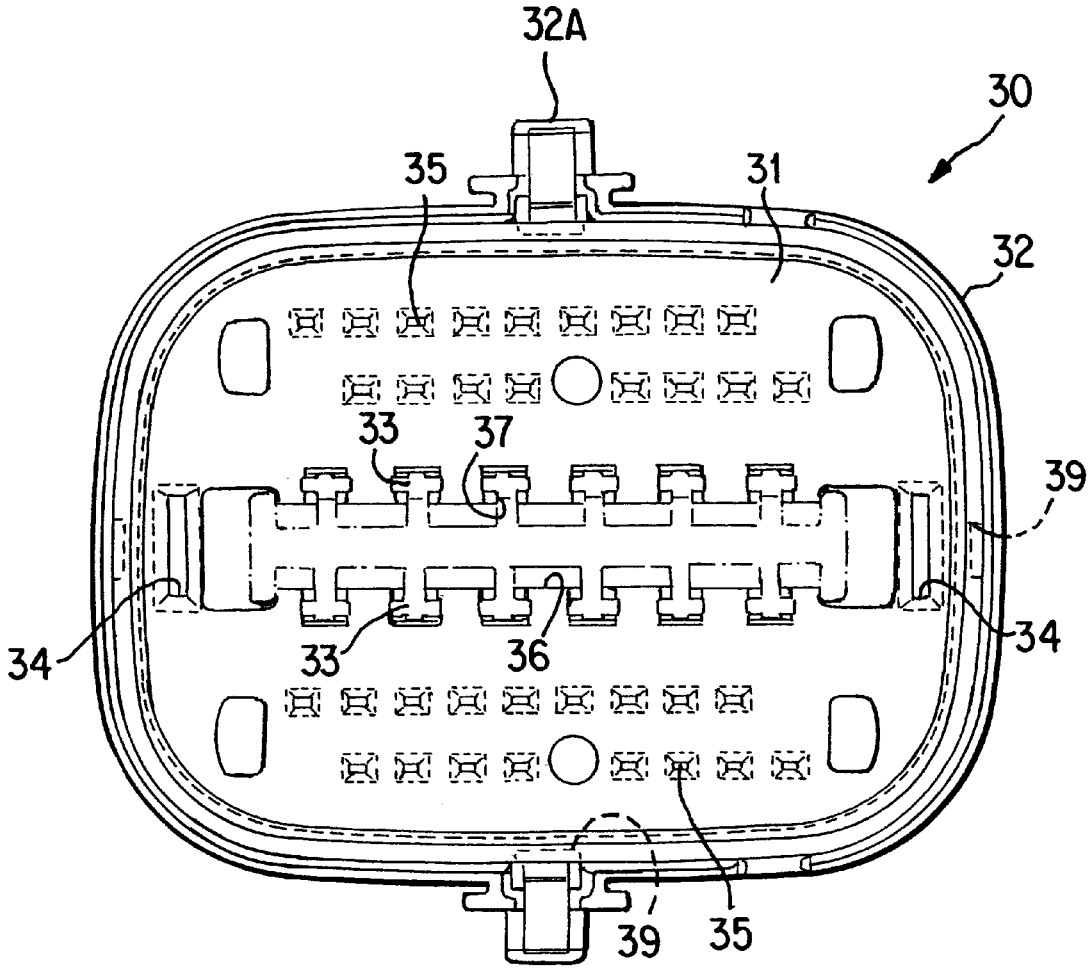
FIG. 6 is a front view showing the retainer fitted through a window hole of a moving plate.
Figure 7:
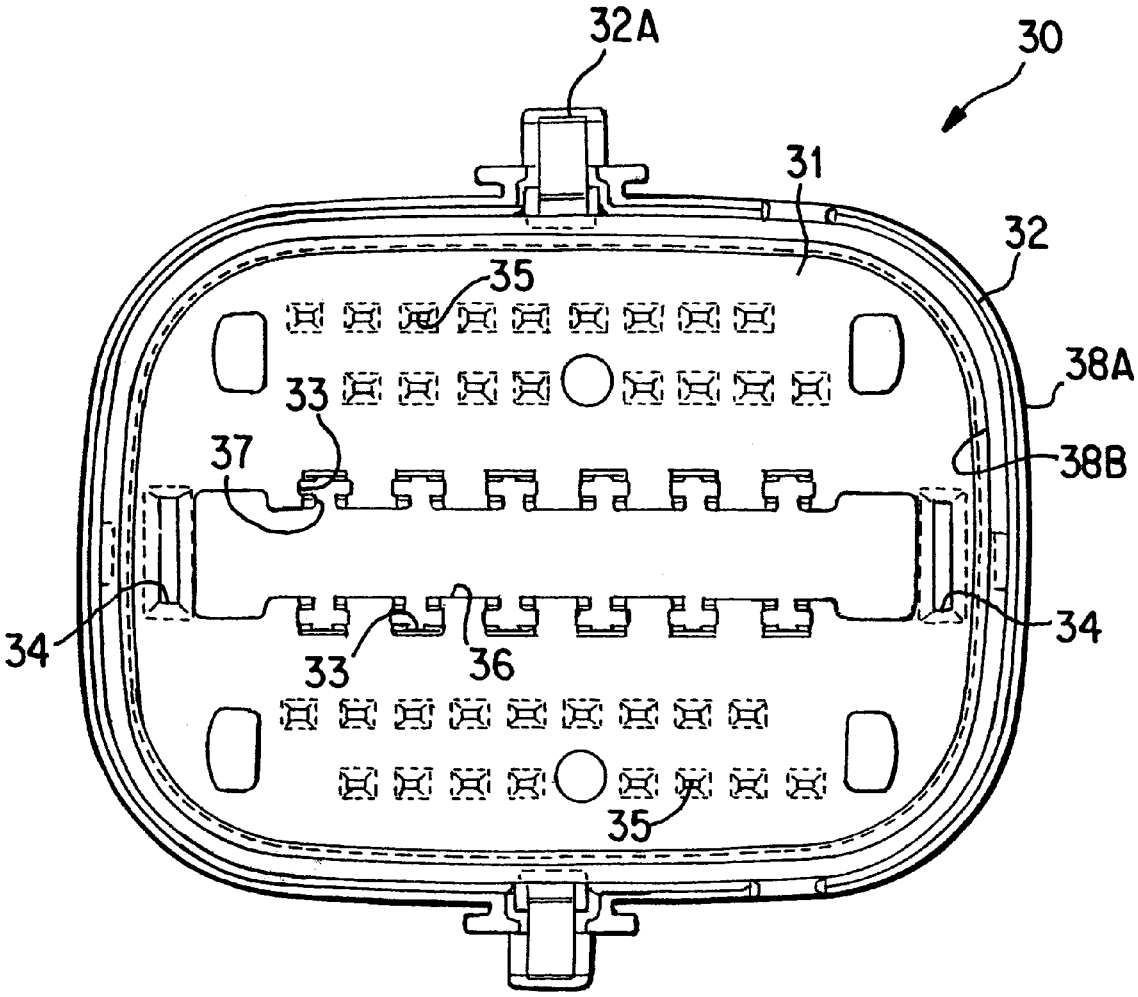
FIG. 7 is a front view of the moving plate.
Figure 8:
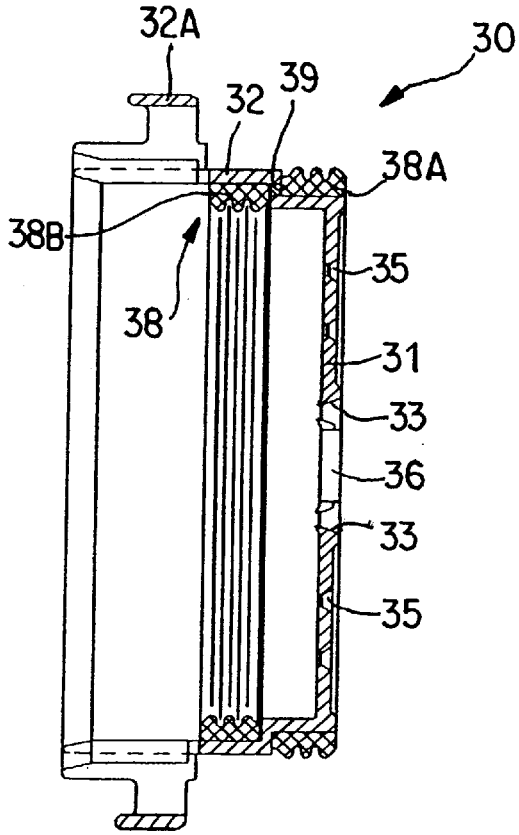
FIG. 8 is a vertical cross-sectional view of the moving plate.
Figure 9:
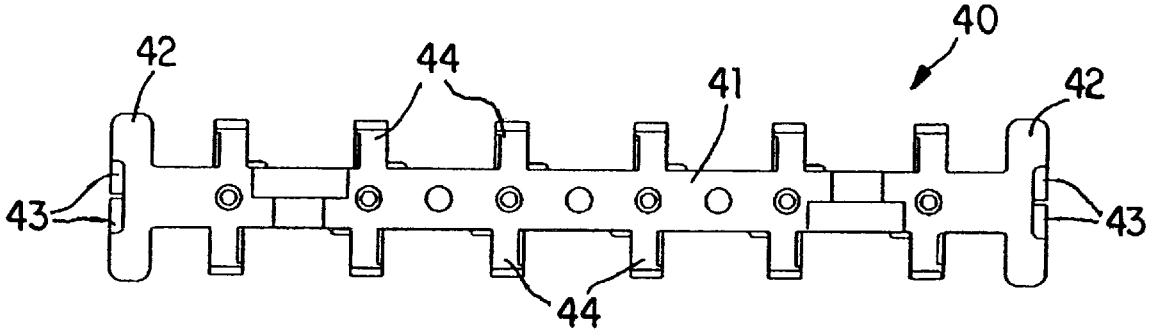
FIG. 9 is a front view of the retainer.
Figure 10:
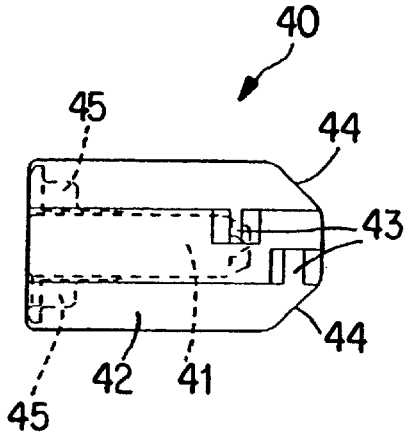
FIG. 10 is a side face view of the retainer.
Figure 11:
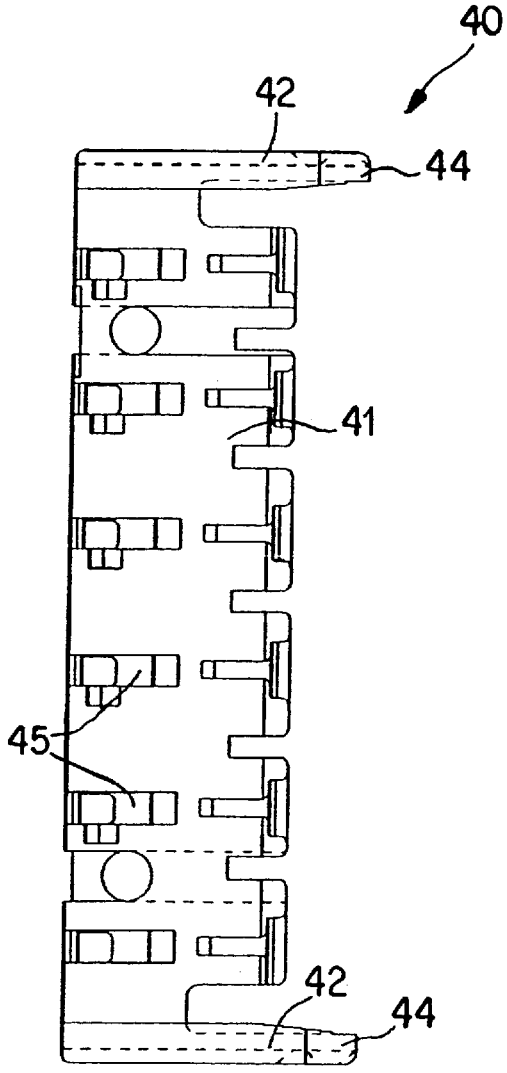
FIG. 11 is a plan view of the retainer.
Figure 12:
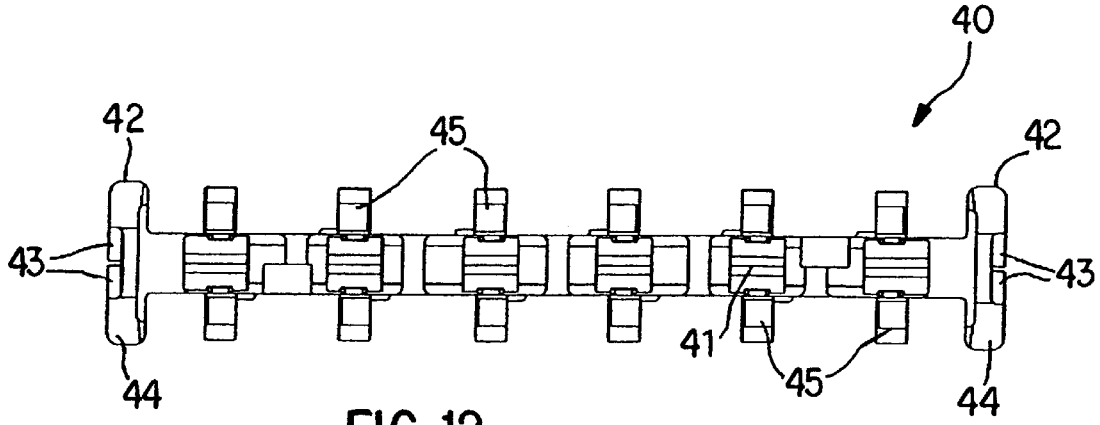
FIG. 12 is a rear face view of the retainer.
Figure 13:
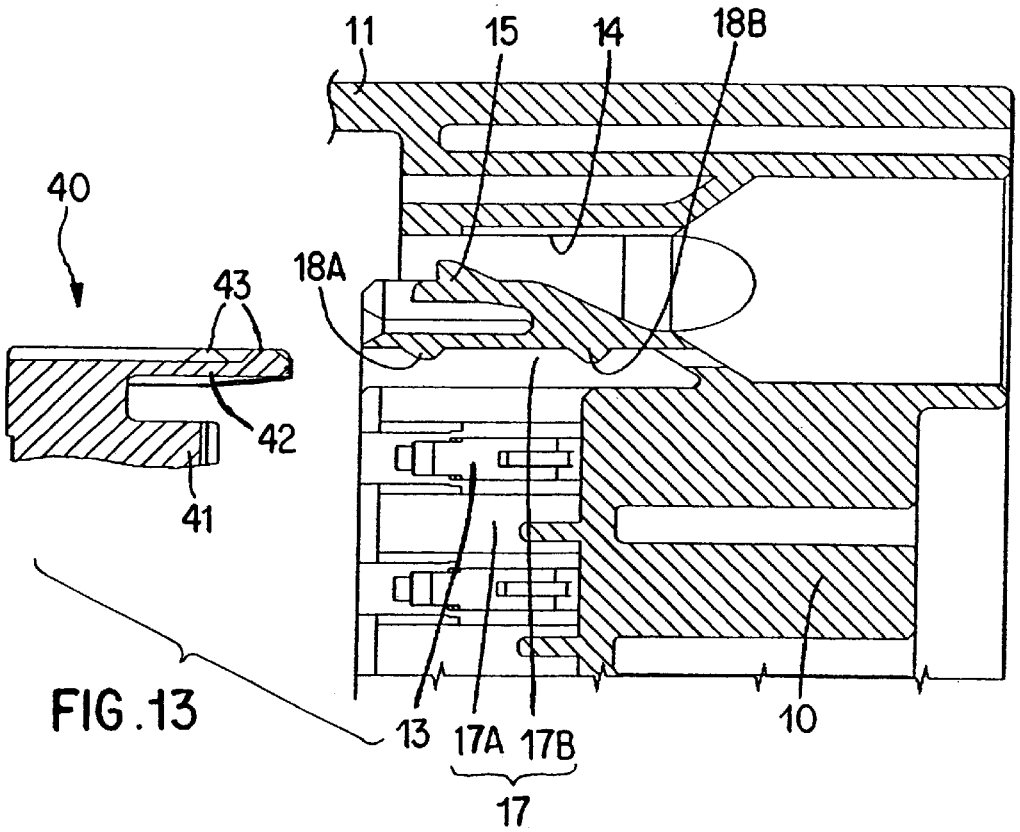
FIG. 13 is a partially enlarged cross-sectional view along line 13—13 in FIG. 5 showing the retainer in a removed state.
Figure 14:
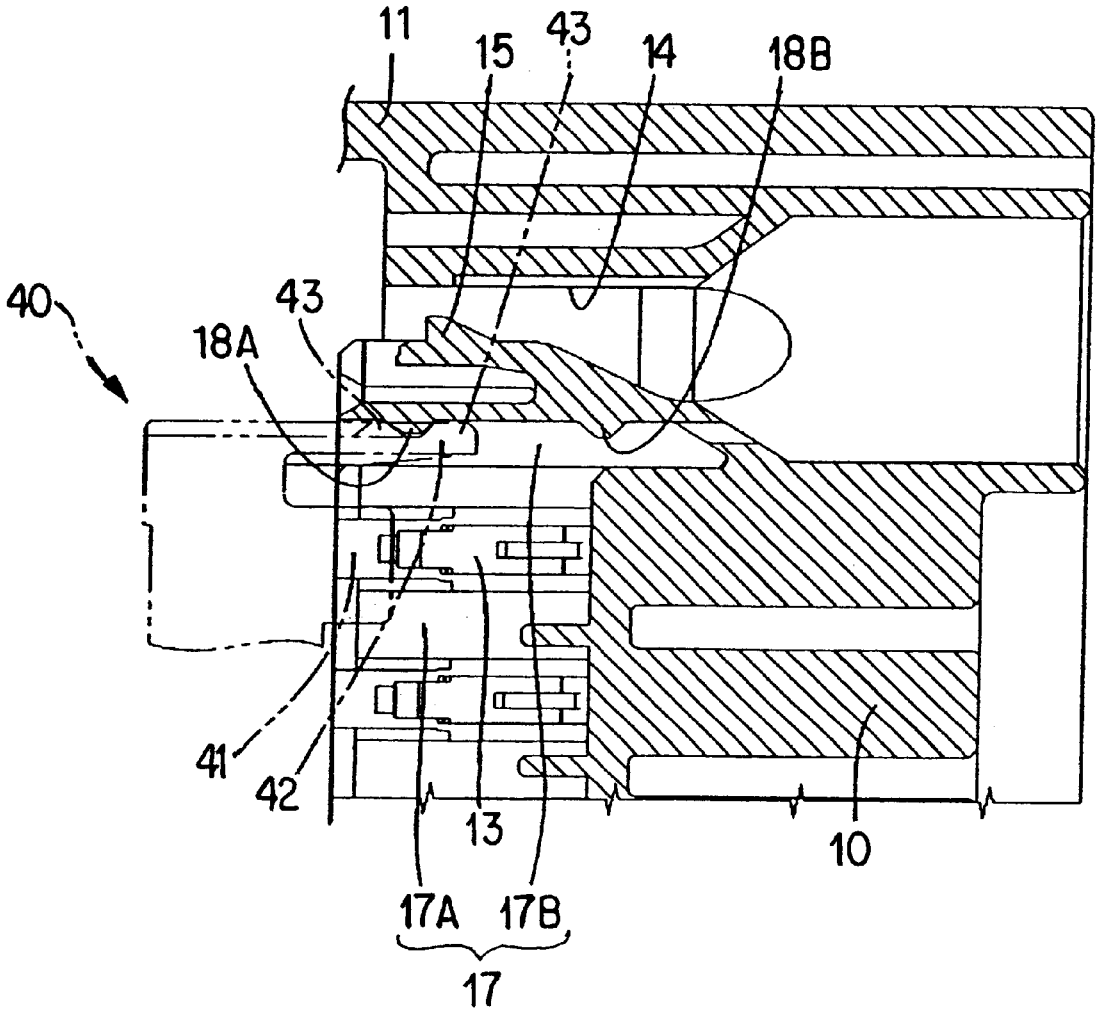
FIG. 14 is a partially enlarged cross-sectional view along the same line as FIG. 13 showing the retainer in the temporary retaining state.
Figure 15:
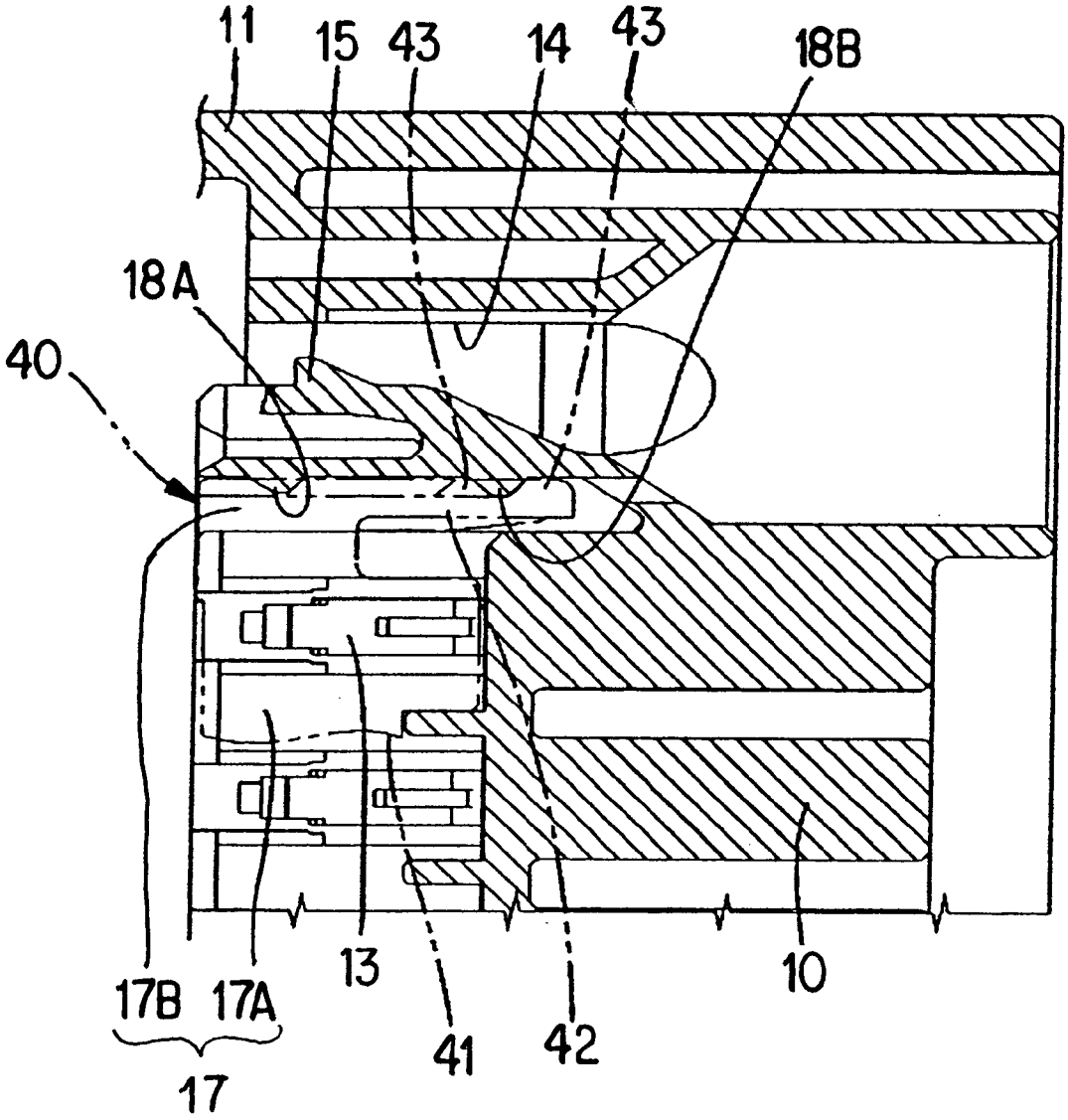
FIG. 15 is a partially enlarged cross-sectional view along the same line as FIG. 13 showing the retainer in the main retaining state.
Figure 16:
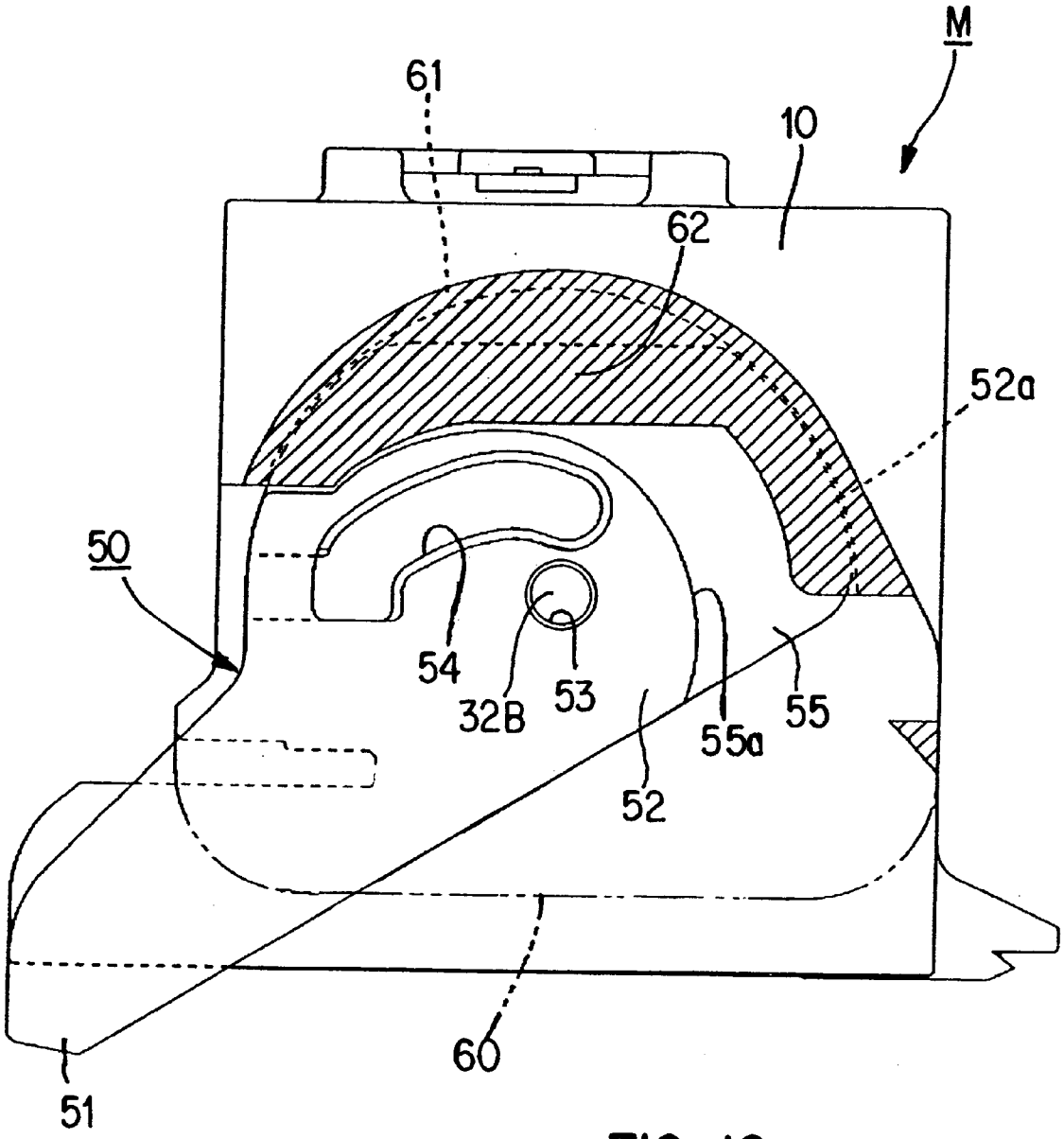
FIG. 16 is a partially cut-away plan view showing a lever in a starting position.
Figure 17:
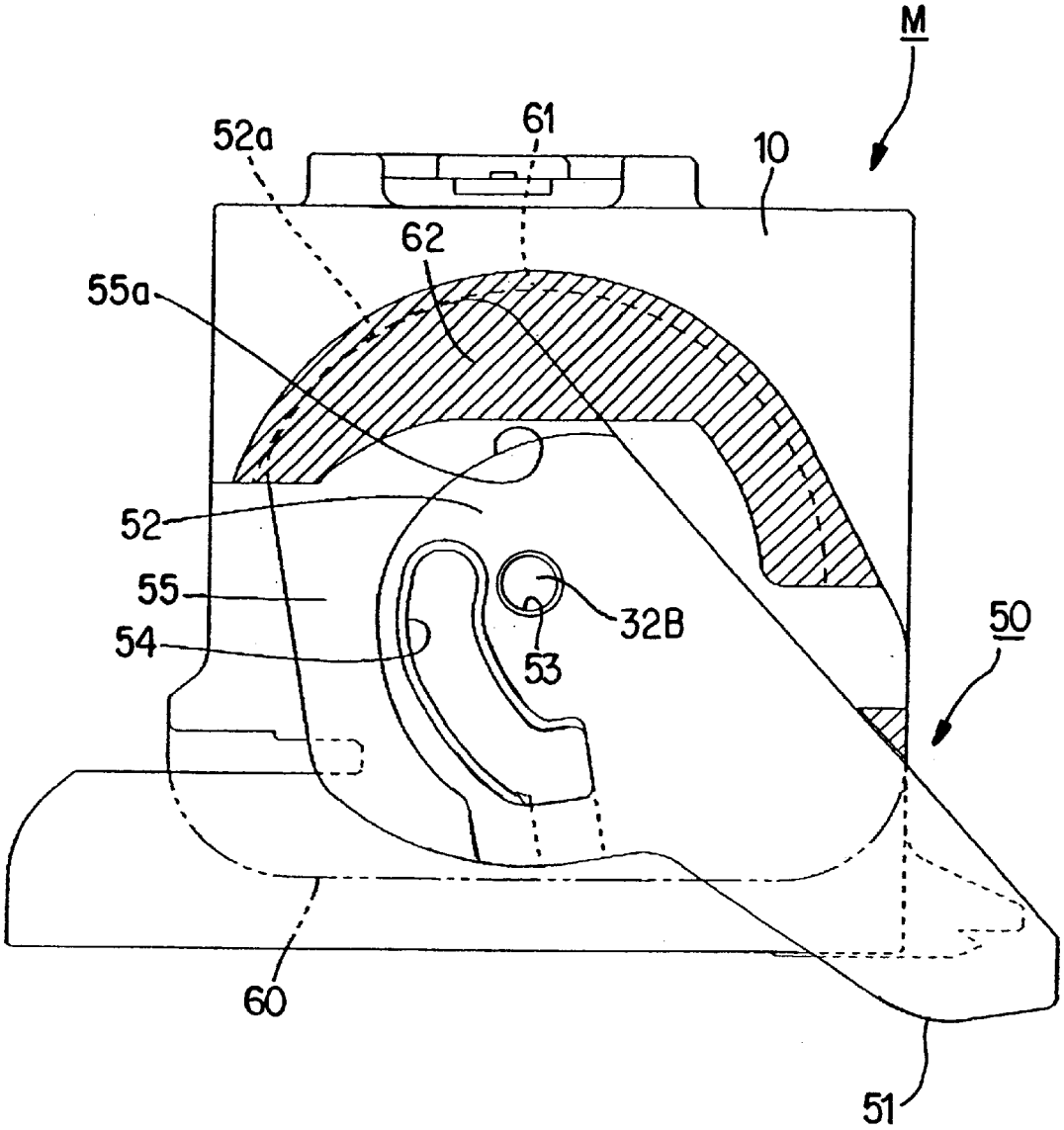
FIG. 17 is a partially cut-away plan view showing the lever in a state whereby it has been rotated to a fitting position.

As shown in FIG. 4, when the female connector F is in a fitted state, the outer circumference sealing member 38A of the moving plate 30 fits tightly with the inner circumference of the hood 11, thereby waterproofing the space between the moving plate 30 and the hood 11. Furthermore, the inner circumference sealing member 38B of the moving plate 30 fits tightly with an outer circumference of the female connector F, thereby waterproofing the space between the moving plate 30 and the female connector F. The sealing member 38 thus seals the space between the hood 11 and the female connector F. Moreover, the retainer attachment hole 17 is located inwards relative to the anterior end face of the connector housing 10 on which the sealing member 38 is located. Consequently, the retainer attachment hole 17 is also waterproofed by the sealing member 38.

While the two connectors M and F are being fitted together, the lever 50 is rotated while the cam pins Fa of the female connector F are in an engaged state within the cam grooves 54, the fitting resistance between the two connectors M and F exerting a force which causes the arms 52 to change shape and move outwards. However, the outer faces of the arms 52 make contact with the inner faces of the protecting walls 60, this preventing the arms 52 from moving outwards. At this juncture, the thin members 55 of the arms 52 make contact with the thick members 62 of the protecting walls 60.

In the embodiment described above, the portions of the protecting walls 60 that make contact with the arms 52 are thick members 62 that are thicker than the remainder thereof. Consequently, the protecting walls 60 do not change shape due to their receiving a pushing force from the arms 52, and these arms 52 are reliably prevented from changing shape. Furthermore, the thick members 62 of the protecting walls 60 are located so as to correspond to the thin members 55 provided in portions of the arms 52. Consequently, the portions where the thick members 62 and the thin members 55 overlap do not become overly thick, and the male connector M, as a whole, does not increase in size.

The halting force of the protecting walls 60, for preventing the arms 52 from moving outwards, is exerted on a location near the outer circumference edges of the arms 52 rather than a location near the rotative centres (the rotative axes 32B) of these arms 52. Consequently, the halting force can remain small. Since the thin members 55 are located at the outer circumference edges of the arms 52, the load on the thick members 62 of the protecting walls 60 is reduced.

Further, it is difficult for the supporting members 61 of the protecting walls 60 to change shape towards the connector housing 10. In the present embodiment, the thick members 62 are formed along these supporting members 61. Consequently, the thick members 62 are more rigid than they would be if they were formed at a location further removed from the supporting members 61.

When the retainer 40 is in the temporary retaining position and the moving plate 30 is in the waiting position, the window hole 36 is covered by the retainer 40. As a result, foreign objects are prevented from entering from the exterior of the hood 11 via the window hole 36, and do not enter the space between the plate main body 31 of the moving plate 30 and the innermost face of the hood 11.

The moving plate 30 has the window hole 36 formed therein on the face opposite the retainer 40. The retainer 40 protrudes towards the anterior via this window hole 36, this allowing the retainer 40 to be pushed (from the temporary retaining position to the main retaining position) from the anterior of the moving plate 30. That is, the retainer 40 can be attached from the anterior relative to the connector housing 10.

Furthermore, the retainer 40 can pass in an anterior-posterior direction through the window hole 36 of the moving plate 30. Consequently, the retainer 40 can be attached after the moving plate 30 has been attached within the hood 11. In the present embodiment, the moving plate 30 is attached first, then the retainer 40 is attached thereafter. However, the retainer 40 may equally well be attached first, and the moving plate 30 attached thereafter.

Since the moving plate 30 has the window hole 36 formed therein, the retainer 40 can be attached from the anterior. This means that the connector housing 10 requires no opening on its outer side face for attaching the retainer 40. Further, the retainer attachment hole 17 is located at the innermost face of the hood 11, thus being surrounded by the inner circumference of the hood 11. Consequently, the fitting portion of the female connector F and the retainer attachment hole 17 can simultaneously be waterproofed merely by providing the sealing member 38 between the inner circumference of the hood 11 and the outer circumference of the female connector F.

The retainer 40 is provided with the guiding members 42 which are inserted prior to the removal preventing member 41 when the retainer 40 is inserted into the retainer attachment hole 17. Consequently, these guiding members 42 are inserted first into the retainer attachment hole 17 when the retainer 40 is being attached, this stabilizing and maintaining the position of the retainer 40 relative to the connector housing 10. By this means, the retainer 40 can be attached smoothly and reliably.

The guiding members 42 are provided as a pair, one at either end of the removal preventing member 41. Consequently, the retainer 40 is less likely to become inclined than in the case where a guiding member is provided on only one end. Further, the tapered guiding tips 44 are formed at the tip ends of the guiding members 42. These simplify the insertion of the guiding members 42 into the retainer attachment hole 17.

The stopping members 43 are formed in the guiding members 42, these maintaining the retainer 40 in the temporary retaining position or the main retaining position. Consequently, the retainer 40, as a whole, is simpler and smaller than in the case where stopping members are provided in locations separate from the guiding members 42.

The present invention is not limited to the embodiments described above with the aid of figures. For example, the possibilities described below also lie within the technical range of the present invention. In addition, the present invention may be embodied in various other ways without deviating from the scope thereof.

(1) In the embodiment described above, the thin members extend along the outer circumference edges of the arms. However, according to the present invention, the thin members may equally well be formed at a location inwards relative to the outer circumference edges of the arms.

(2) In the embodiment described above, the thick members are formed along the supporting members that support the protecting walls on the connector housing. However, according to the present invention, the thick members may equally well be formed at a location removed from these supporting members.

(3) In the embodiment described above, the arm members are not circular. However, according to the present invention, the outer circumference edges of the arms may equally well be arc shaped and concentric to the rotative axes of the levers. In that case, the thick members may be formed along the arc-shaped outer circumference edges of the arms. The thin members may also be formed along the outer circumference edges of the arms in the same manner.

(4) In the embodiment described above, the case was described whereby the lever supporting member is a connector housing that houses terminal fittings and sub connectors. However, the present invention is equally suitable for cases whereby the lever supporting member is: a connector housing that only has terminal fittings inserted therein; an electric wire cover attached to a connector housing which has terminal fittings inserted therein and supporting electric wires that extend from that connector housing; a frame that houses only sub connectors.

What is claimed is:

1. A lever-type connector comprising a housing having a lever pivoted thereon, said lever defining a cam groove for engagement with a cam follower of a mating connector whereby rotation of said lever relative to said housing causes said connectors to be drawn into engagement, wherein the housing includes a protective wall extending partly over said lever to prevent bending thereof in a direction perpendicular to the plane of movement thereof, wherein a thinned portion of said lever corresponds with a thickened portion of said protective wall, whereby said lever is plate-like, an outer part thereof being said thinned portion.

2. A connector according to claim 2 wherein said lever has an arcuate peripheral edge, said thinned portion being provided along said edge.

3. A connector according to claim 1 wherein said lever comprises arms on opposite sides of said housing and pivotable about an axis, an operating member joining the free ends of said arms, and protective walls extending over said arms.

4. A lever-type connector comprising a housing having a lever pivoted thereon, said lever defining a cam groove for engagement with a cam follower of a mating connector whereby rotation of said lever relative to said housing causes said connectors to be drawn into engagement, wherein the housing includes a protective wall extending partly over said lever to prevent bending thereof in a direction perpendicular to the plane of movement thereof, wherein a thinned portion of said lever corresponds with a thickened portion of said protective wall wherein said protective wall is connected to said housing by a web, and said thickened portion is immediately adjacent said web.

5. A connector according to claim 4 wherein said web is arcuate.

* * * * *